US008261683B2

(12) United States Patent
Knoblett et al.

(10) Patent No.: US 8,261,683 B2
(45) Date of Patent: Sep. 11, 2012

(54) INTERCHANGEABLE SEAT SYSTEM

(75) Inventors: Michael Knoblett, Newnan, GA (US); Otsuka Kenichi, Newnan, GA (US)

(73) Assignee: Yamaha Motor Manufacturing Corporation of America, Newnan, GA (US)

( * ) Notice: Subject to any disclaimer, the term of this patent is extended or adjusted under 35 U.S.C. 154(b) by 772 days.

(21) Appl. No.: 12/172,359

(22) Filed: Jul. 14, 2008

(65) Prior Publication Data

US 2010/0006019 A1 Jan. 14, 2010

(51) Int. Cl.
*B63B 29/00* (2006.01)

(52) U.S. Cl. ..... 114/363

(58) Field of Classification Search ..... 114/363, 114/55.57; 297/195.12, 195.13
See application file for complete search history.

(56) References Cited

U.S. PATENT DOCUMENTS

| | | | | |
|---|---|---|---|---|
| 6,145,458 | A | 11/2000 | Hattori | |
| 6,918,348 | B2 | 7/2005 | Matsuda et al. | |
| 7,377,347 | B2 * | 5/2008 | Rasidescu et al. | 180/190 |
| 7,380,629 | B2 * | 6/2008 | Vaisanen | 180/190 |
| 2001/0000052 | A1 * | 3/2001 | Yamada et al. | 114/55.53 |

* cited by examiner

*Primary Examiner* — Edwin Swinehart
(74) *Attorney, Agent, or Firm* — Keating & Bennett, LLP

(57) ABSTRACT

An interchangeable seat system for a water vehicle includes a front seat member, a common base member, at least two rear seat members, and at least two hand grips. One of the at least two rear seat members and one of the at least two hand grips are configured such that a combination of the front seat member, the common base member, the one of the at least two rear seat member and the one of the at least two hand grips provides a two-person seat configuration for the water vehicle, and another one of the at least two rear seat members and another one of the at least two hand grips are configured such that a combination of the front seat member, the common base member, the another one of the at least two rear seat member and the another one of the at least two hand grips provides a three-person seat configuration for the water vehicle.

22 Claims, 11 Drawing Sheets

INTERCHANGEABLE SEAT SYSTEM

BACKGROUND OF THE INVENTION

1. Field of the Invention

The present invention relates to an interchangeable seat system, and more particularly, to an interchangeable seat system for a water vehicle which enables the water vehicle to be selectively configured as a two-person water vehicle or a three-person water vehicle.

2. Description of the Related Art

Conventional water vehicles are specifically manufactured to be one of a two-person water vehicle or a three-person water vehicle. Thus, the structure and configuration of the two-person water vehicle are different from the structure and configuration of the three-person water vehicle.

Accordingly, a given water vehicle cannot be selectively or optionally configured to be either a two-person water vehicle or a three-person water vehicle, as desired. As a result, conventional water vehicles must be separately manufactured to be either a two-person water vehicle or a three-person water vehicle, with no flexibility or selectivity as to the type of water vehicle will be manufactured.

Accordingly, the overall cost of manufacturing two- and three-person water vehicles is increased because they must be separately designed and manufactured. In addition, since the seating configuration cannot be modified in conventional water vehicles, if owners of the water vehicle decide, after purchasing, for example, a two-person water vehicle, that they would rather have, for example, a three-person water vehicle, then their only choice is to purchase another water vehicle having the desired seat configuration. Thus, the cost imposed on the owners is greatly increased.

U.S. Pat. No. 6,918,348 discloses a water vehicle having various different rear cowlings. However, in each of the embodiments disclosed in U.S. Pat. No. 6,918,348, the resulting water vehicle is always a two-person water vehicle. U.S. Pat. No. 6,918,348 does not disclose any structure which would enable a given water vehicle to be selective configured as either a two-person water vehicle or a three-person water vehicle.

SUMMARY OF THE INVENTION

To overcome the problems described above, preferred embodiments of the present invention provide an interchangeable seat system for a water vehicle including interchangeable rear seat portions which enable the water vehicle to be selectively configured as either a two-person water vehicle or a three-person water vehicle.

An interchangeable seat system according to a preferred embodiment of the present invention includes a front seat member, a common base member, and at least two rear seat members, wherein one of the at least two rear seat members is configured such that a combination of the front seat member, the common base member, and the one of the at least two rear seat members provides a two-person seat configuration for the water vehicle, and another one of the at least two rear seat members is configured such that a combination of the front seat member, the common base member, and the another one of the at least two rear seat members provides a three-person seat configuration for the water vehicle.

The interchangeable seat system preferably further includes at least two hand grips, wherein the one of the at least two rear seat members and one of the at least two hand grips are configured such that a combination of the front seat member, the common base member, the one of the at least two rear seat members, and the one of the at least two hand grips provides a two-person seat configuration for the water vehicle, and the another one of the at least two rear seat members and another one of the at least two hand grips are configured such that a combination of the front seat member, the common base member, the another one of the at least two rear seat members, and the another one of the at least two hand grips provides a three-person seat configuration for the water vehicle.

Preferably, in the two-person seat configuration, the one of the at least two rear seat members is mounted on the common base member, and in the three-person seat configuration, the another one of the at least two rear seat members is mounted on the common base member.

Preferably, in the two-person seat configuration, the one of the at least two rear seat members and the one of the at least two hand grips are mounted on the common base member, and in the three-person seat configuration, the another one of the at least two rear seat members and the another one of the at least two hand grips are mounted on the common base member.

The common base member preferably includes at least one receptacle, and each of the at least two rear seat members includes at least one projection arranged to be engaged with the at least one receptacle of the common base member when a respective one of the at least two rear seat members is mounted on the common base member.

The interchangeable seat system preferably further includes a container, wherein the common base member includes an opening arranged to accommodate the container therein.

Each of the at least two rear seat members preferably includes a sealing member disposed on a lower surface thereof, and the sealing member is preferably arranged to be engaged with the container when a respective one of the at least two rear seat members is mounted on the common base member so as to provide a water tight seal between the container and the respective one of the at least two rear seat members.

The common base member preferably includes at least one receptacle, and each of the at least two rear seat members preferably includes at least one projection arranged to be engaged with the at least one receptacle of the common base member when a respective one of the at least two rear seat members is mounted on the common base member.

The interchangeable seat system preferably further includes a container, wherein the common base member includes an opening arranged to accommodate the water tight container therein.

Each of the at least two rear seat members preferably includes a sealing member disposed on a lower surface thereof, and the sealing member is arranged to be engaged with the container when a respective one of the at least two rear seat members is mounted on the common base member so as to provide a water tight seal between the container and the respective one of the at least two rear seat members.

A water vehicle according to another preferred embodiment of the present invention includes a hull, a deck attached to the hull, and the interchangeable seat system described above that is arranged to be mounted on the deck.

The deck preferably includes an access opening, and the interchangeable seat system is arranged to cover the access opening.

A method of mounting a seat on a deck of a water vehicle according to another preferred embodiment of the present invention includes the steps of mounting a common base member on the deck, selectively mounting one of at least two rear seat members on the common base member, and mounting a front seat member on the deck after the one of the at least two rear seat member has been mounted on the common base member, wherein one of the at least two rear seat members is configured such that a combination of the front seat member, the common base member, and the one of the at least two rear seat members forms a two-person seat configuration, and another one of the at least two rear seat members is configured such that a combination of the front seat member, the common base member, and the another one of the at least two rear seat members forms a three-person seat configuration.

The deck preferably includes an access opening, and the common base member, the one of the at least two hand grips, the one of the at least two rear seat members, and the front seat member are mounted so as to cover the access opening.

The step of mounting the one of the at least two rear seat members preferably includes the step of inserting at least one projection provided on the one of the at least two rear seat members into at least one receptacle provided on the common base member.

The method according to this preferred embodiment preferably further includes the steps of providing a container in an opening in the common base member, providing a sealing member on a lower surface of the one of the at least two rear seat members, and forming a water tight seal between the one of the at least two rear seat members and the container in the step of mounting the one of the at least two rear seat members.

A method of mounting a seat on a deck of a water vehicle according to another preferred embodiment of the present invention includes the steps of mounting a common base member on the deck, selectively mounting one of at least two hand grips on the common base member, selectively mounting one of at least two rear seat members on the one of the at least two hand grips and on the common base member, and mounting a front seat member on the deck after the one of the at least two hand grips and the one of the at least two rear seat member have been mounted on the common base member, wherein one of the at least two rear seat members and one of the at least two hand grips are configured such that a combination of the front seat member, the common base member, the one of the at least two rear seat members and the one of the at least two hand grips forms a two-person seat configuration, and another one of the at least two rear seat members and another one of the at least two hand grips are configured such that a combination of the front seat member, the common base member, the another one of the at least two rear seat members, and the another one of the at least two hand grips forms a three-person seat configuration.

The deck preferably includes an access opening, and the common base member, the one of the at least two hand grips, the one of the at least two rear seat members, and the front seat member are mounted so as to cover the access opening.

The step of mounting the one of the at least two rear seat members preferably includes the step of inserting at least one projection provided on the one of the at least two rear seat members into at least one receptacle provided on the common base member.

The method according to this preferred embodiment preferably further includes the steps of providing a container in an opening in the common base member, providing a sealing member on a lower surface of the one of the at least two rear seat members, and forming a water tight seal between the one of the at least two rear seat members and the container in the step of mounting the one of the at least two rear seat members.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below with reference to the drawings.

Figure 1:
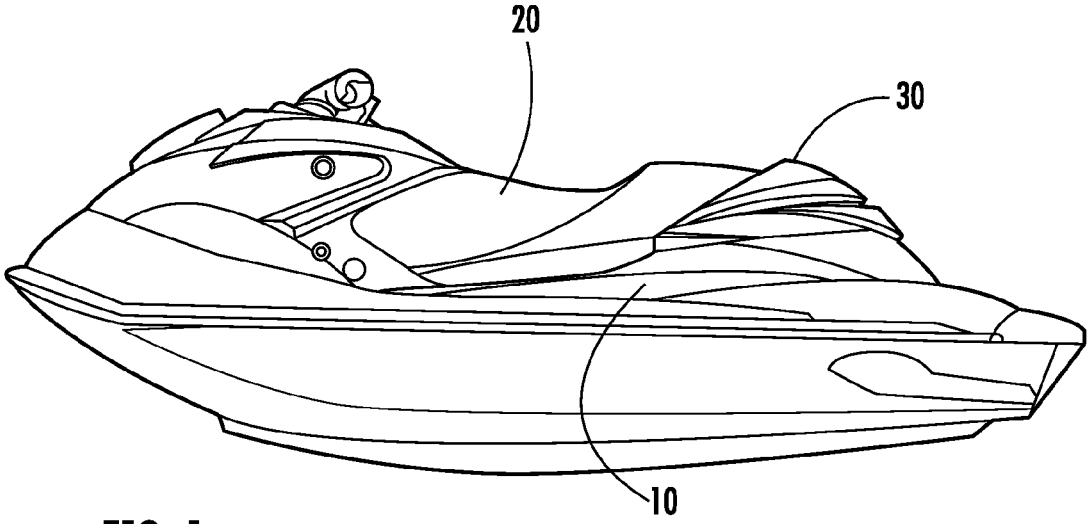
FIG. 1 is a side view of a water vehicle including the interchangeable seat system according to a preferred embodiment of the present invention having a two-person configuration.
Figure 2:
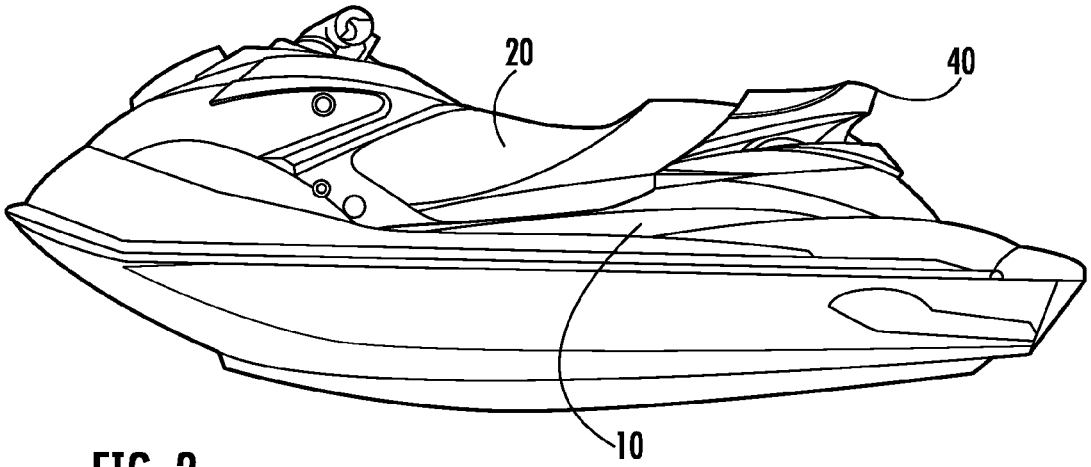
FIG. 2 is a side view of the water vehicle shown in FIG. 1 having a three-person configuration.
Figure 3:
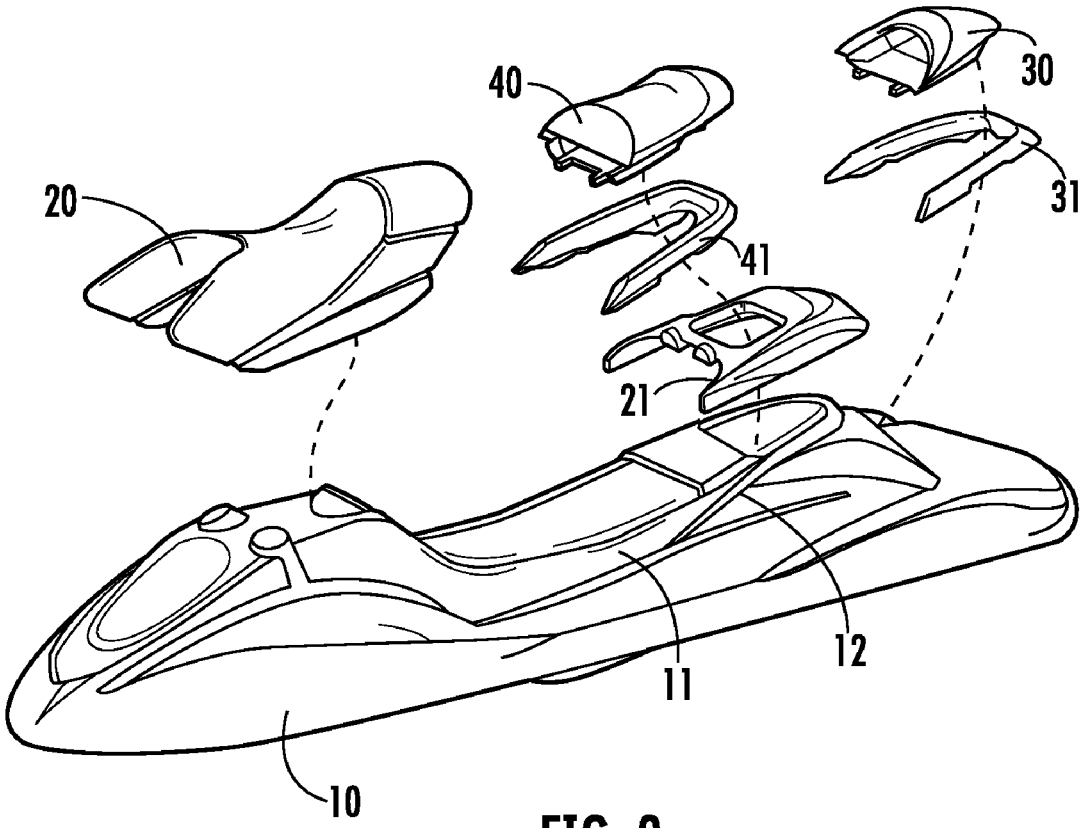
FIG. 3 is an exploded view of the interchangeable seat system according to the preferred embodiment shown in FIGS. 1 and 2 in relation to the deck of the water vehicle shown in FIG. 1.

As shown in FIGS. 1-3, a deck 10 of a water vehicle includes an access opening 11 which provides access to an engine compartment disposed below the access opening 11. The deck 10 further includes a deck beam 12.

An interchangeable seat system includes a front seat member 20 which is configured to accommodate two people, for example, a common base member 21, two rear seat members 30 and 40, and two hand grips 31 and 41.

The front seat member 20 is attached to the deck 10 and arranged to cover a forward portion of the access opening 11 in the deck 10. The common base member 21 is attached to the deck beam 12 and arranged to cover a rear portion of the access opening 11 in the deck 10.

The front seat member 20 and the common base member 21 preferably are used in a two-person configuration and in a three-person configuration of the interchangeable seat system. In the two-person configuration the hand grip 31 and the rear seat portion 30 are attached to the common base member 21, and in the three-person configuration, the hand grip 41 and the rear seat portion 40 are attached to the common base member 21.

Figure 4A:
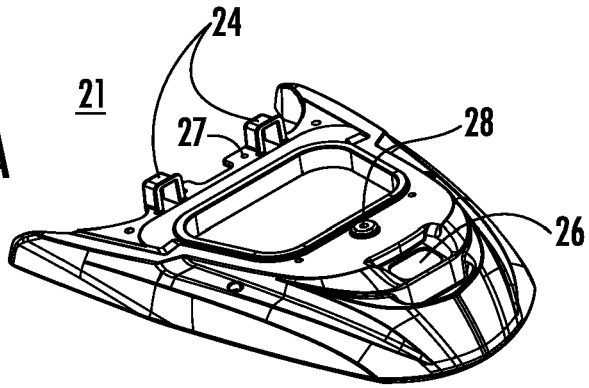
FIGS. 4A to 4C are views of a common base member of the interchangeable seat system shown in FIG. 3.
Figure 4B:
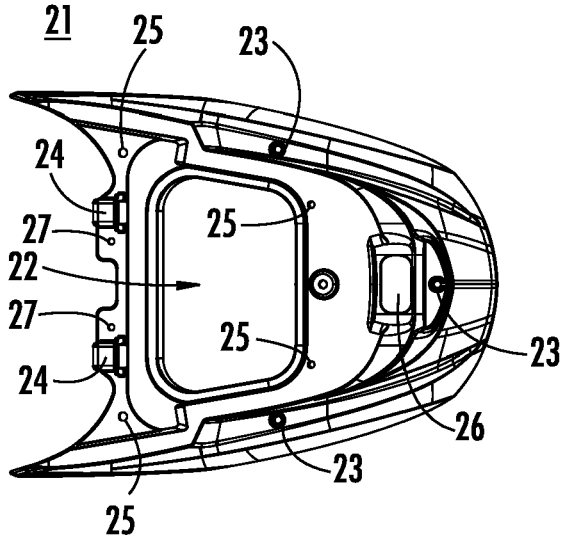
Figure 4C:
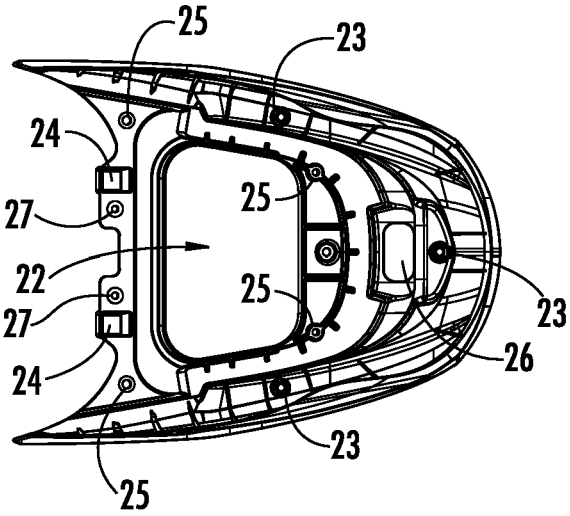

As shown in FIGS. 4A to 4C the common base member 21 includes an opening 22 which accommodates a container 50, a plurality of holes 23 for mounting the common base member 21 to the deck 10, a plurality of holes 27 for mounting the common base member 21 to the deck beam 12, receptacles 24 for receiving projections 33 and 43 of the rear seat members 30 and 40 (see, for example, FIGS. 6A to 6C and 8A to 8C), a plurality of holes 25 for mounting the hand grips 31 and 41 to the common base member 21 and the deck 10, a depression 26 arranged to provide access to the handles 37 and 46 used to remove the rear seat members 30 and 40, which will be described below, and a mounting peg 28 arranged to be engaged with one of the mounting members 36 and 46 of the rear seat members 30 and 40.

The container 50 is preferably a water tight container to protect items placed in the container 50 from getting wet. However, the container 50 is not necessarily water tight, and any suitable container can be used.

Figure 5A:
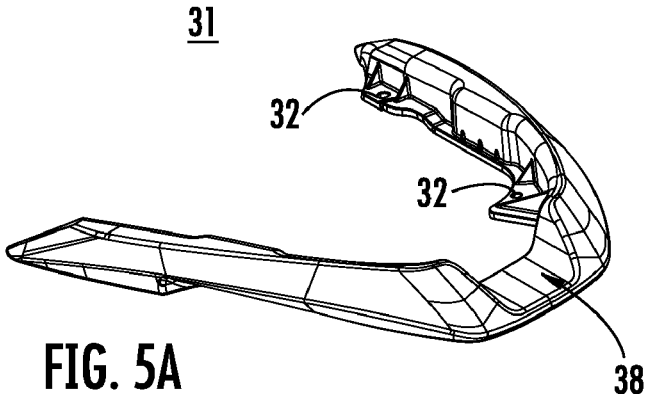
FIGS. 5A to 5C are views of a frame member for a two-person configuration of the interchangeable seat system shown in FIG. 3.
Figure 5B:
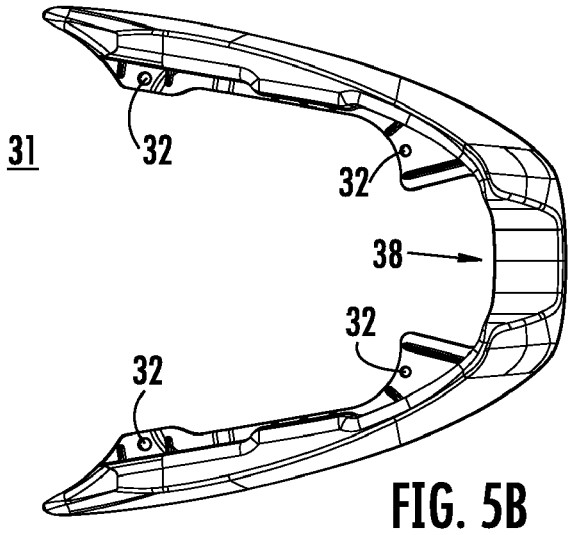
Figure 5C:
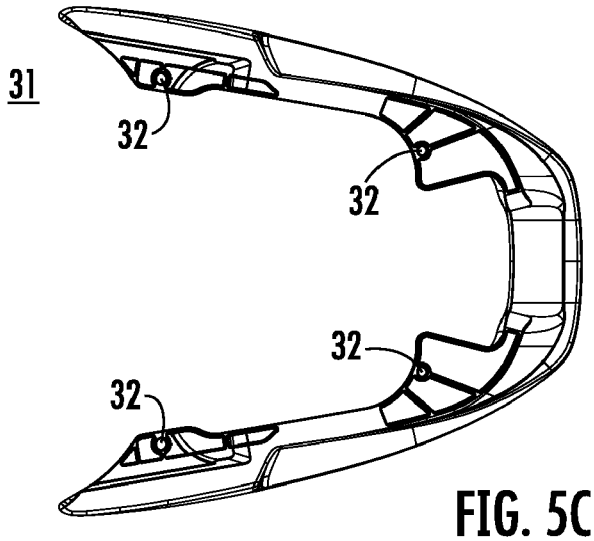

As shown in FIGS. 5A to 5C, the hand grip 31 includes a plurality of holes 32 that are aligned with the plurality of holes 25 in the common base member 21 such that a fastener (not shown) can be inserted through the holes 32 and 25 to attach the hand grip 31 to the deck 10. Although four holes 25 and four holes 32 are shown in the present preferred embodiment, for example, any suitable number of holes may be provided to attach the hand grip 31 to the deck 10. In addition, any suitable type of fastener may be used to attach the hand grip 31 to the deck 10, such as screws, bolts, rivets, pins, snaps, and adhesives. Furthermore, any suitable joining method may be used to attach the hand grip 31 to the deck 10, such as ultrasonic welding, heat staking, heat welding, and hot plate welding.

In addition, the hand grip 31 includes an access opening 38 for accessing the handle 37 of the rear seat member 30.

Figure 6A:
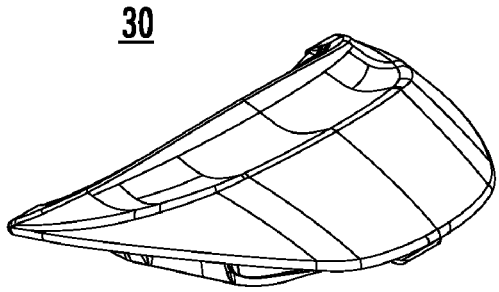
FIGS. 6A to 6C are views of a rear seat member for a two-person configuration of the interchangeable seat system shown in FIG. 3.
Figure 6B:
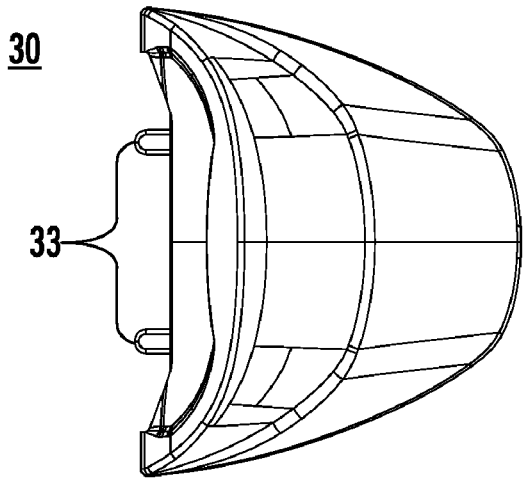
Figure 6C:
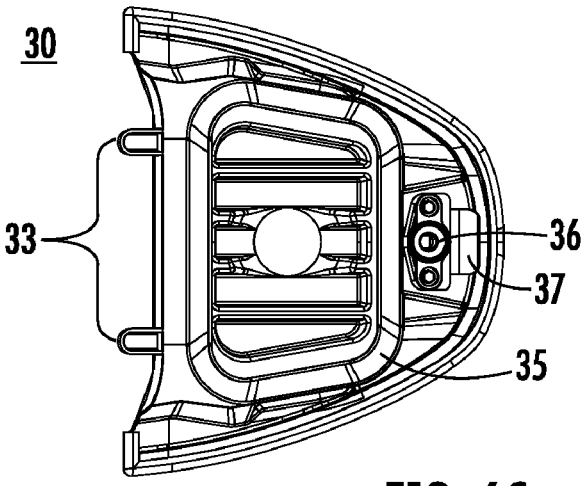

As shown in FIGS. 6A to 6C, the rear seat member 30 includes the projections 33 which are inserted into the receptacles 24 of the common base member 21 when the rear seat member 30 is mounted on the common base member 21, a sealing member 35 provided on the lower surface of the rear seat portion 30 which provides a water tight seal with the container 50 when the rear seat member 30 in mounted on the common base member 21, and a mounting member 36 which is engaged with the mounting peg 28 of the common base member 21 so as to securely mount the rear seat member 30 to the common base member 21. The rear seat portion 30 is removably mounted on the common base member 21 to provide access to the container 50.

As shown in FIG. 1, the rear seat member 30 preferably extends rearwardly and downwardly and does not extend upwardly. The shape of the rear seat member 30 is designed to enable a passenger on the water vehicle to sit facing rearwardly so that the passenger can observe a person being towed behind the water vehicle, such as a wake boarder or water skier.

Figure 7A:
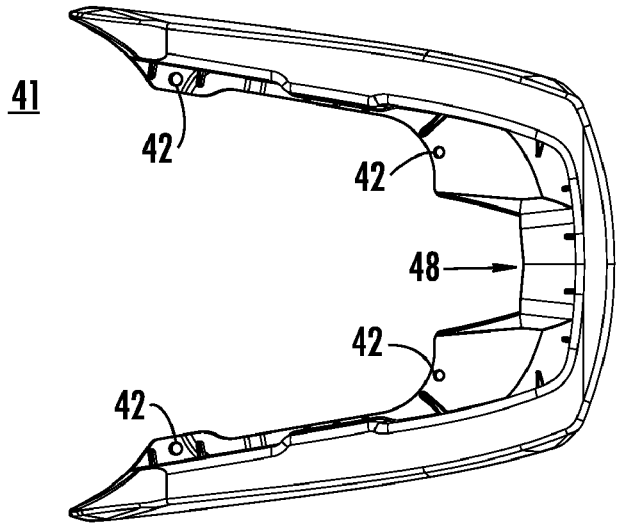
FIGS. 7A to 7C are views of a frame member for a three-person configuration of the interchangeable seat system shown in FIG. 3.
Figure 7B:
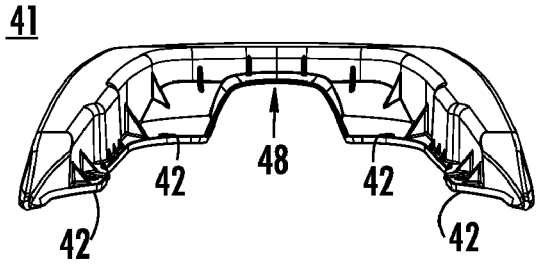
Figure 7C:
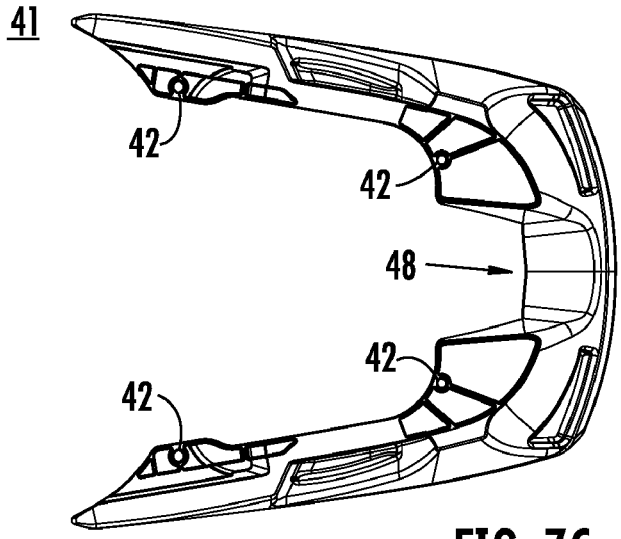

As shown in FIGS. 7A to 7C, the hand grip 41 includes a plurality of holes 42 that are aligned with the plurality of holes 25 in the common base member 21 such that a fastener (not shown) can be inserted through the holes 42 and 25 so as to attach the hand grip 41 to the deck 10. Although four holes 25 and four holes 42 are shown in the preferred embodiment, for example, any suitable number of holes may be provided to attach the hand grip 41 to the deck 10. In addition, any suitable type of fastener may be used to attach the hand grip 41 to the deck 10, such as screws, bolts, rivets, pins, snaps, and adhesives. Furthermore, any suitable joining method may be used to attach the hand grip 41 to the deck 10, such as ultrasonic welding, heat staking, heat welding, and hot plate welding.

In addition, the hand grip 41 includes an access opening 48 for accessing the handle 47 of the rear seat member 40.

The hand grips 31 and 41 and the common base member 21 are preferably made of plastic, and more preferably of polypropylene (PP). However, the hand grips 31 and 41 and the common base member 21 may be made of any suitable material, such as metal, wood, or fiberglass.

Figure 8A:
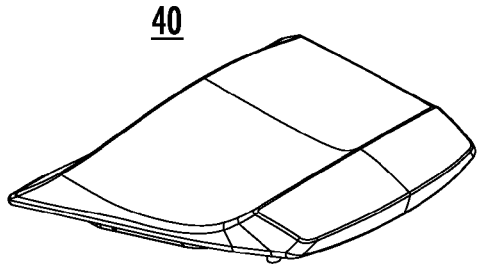
FIGS. 8A to 8C are views of a rear seat member for a three-person configuration of the interchangeable seat system shown in FIG. 3.
Figure 8B:
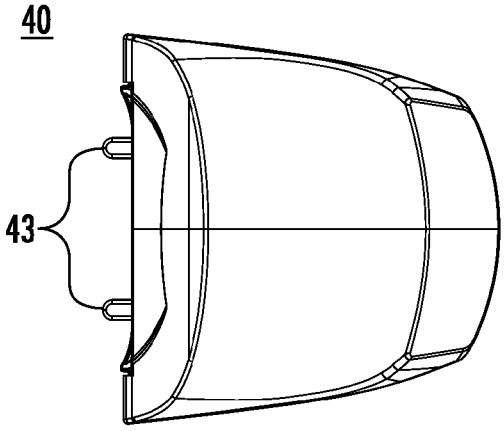
Figure 8C:
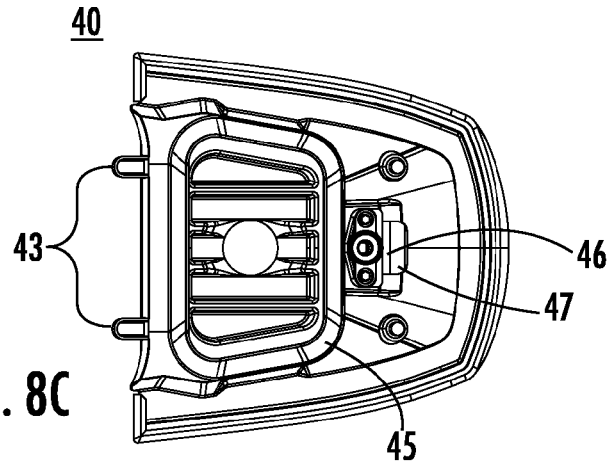

As shown in FIGS. 8A to 8C, the rear seat member 40 includes the projections 43 which are inserted into the receptacles 24 of the common base member 21 when the rear seat member 40 is mounted on the common base member 21, a sealing member 45 provided on a lower surface of the rear seat member 40 which provides a water tight seal with the container 50 when the rear seat member 40 in mounted on the common base member 21, and a mounting member 46 which is engaged with the mounting peg 28 of the common base member 21 so as to securely mount the rear seat member 40 to the common base member 21. The rear seat portion 40 is removably mounted on the common base member 21 to provide access to the water tight container 50.

As shown in FIG. 2, the rear seat member 40 preferably extends rearwardly and upwardly and does not extend downwardly. The rear seat portion 40 is designed to enable three people to comfortably sit on the seat facing in a forward direction. Accordingly, the rear seat member 40 is configured to provide hip support for a third person riding on the water vehicle.

Figure 9A:
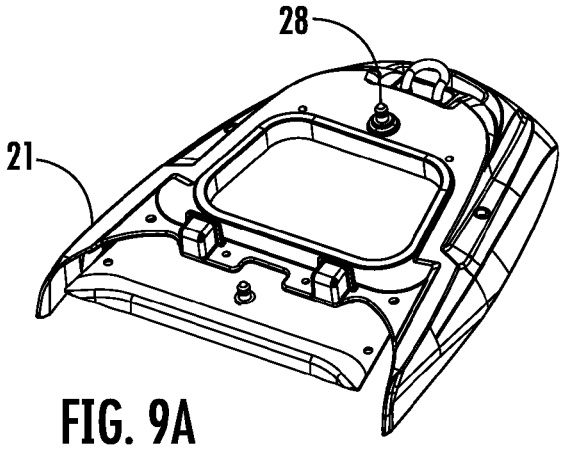
FIGS. 9A to 9E show a process of assembling the interchangeable seat system into a two-person configuration.
Figure 9B:
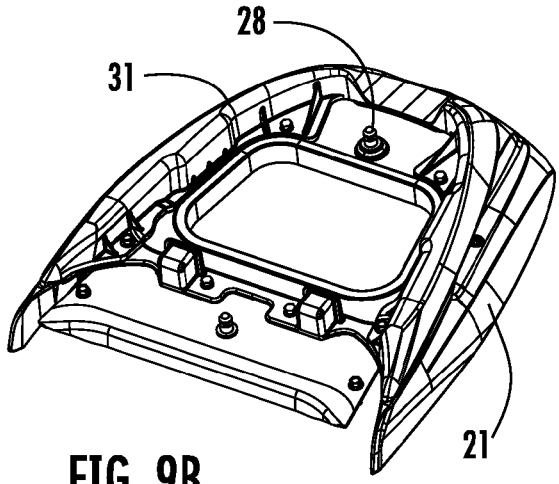
Figure 9C:
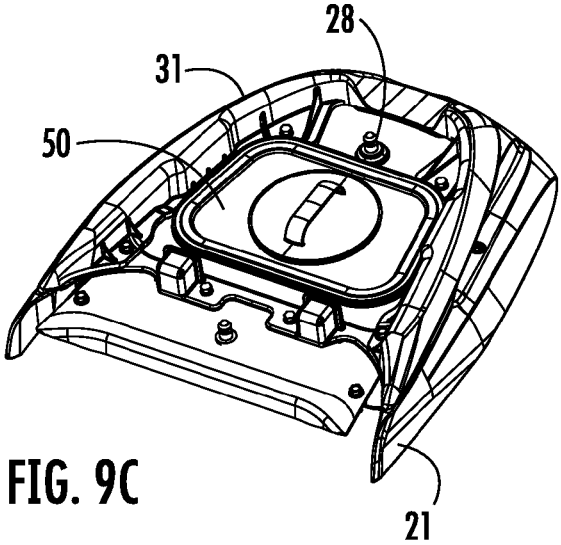
Figure 9D:
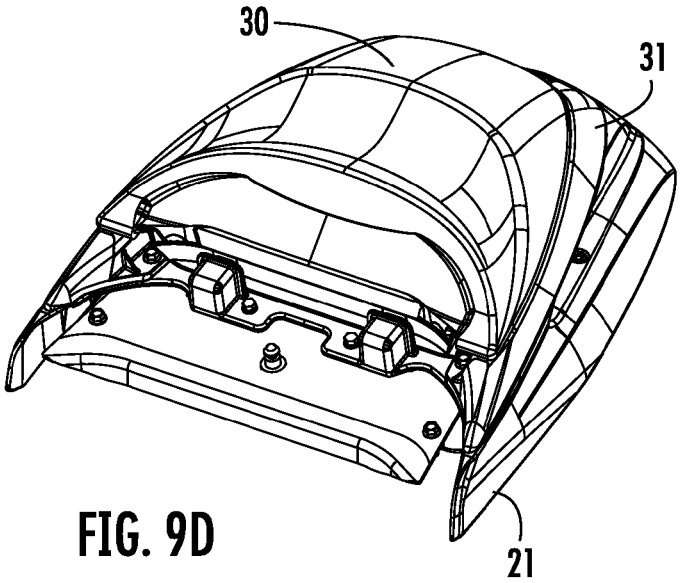
Figure 9E:
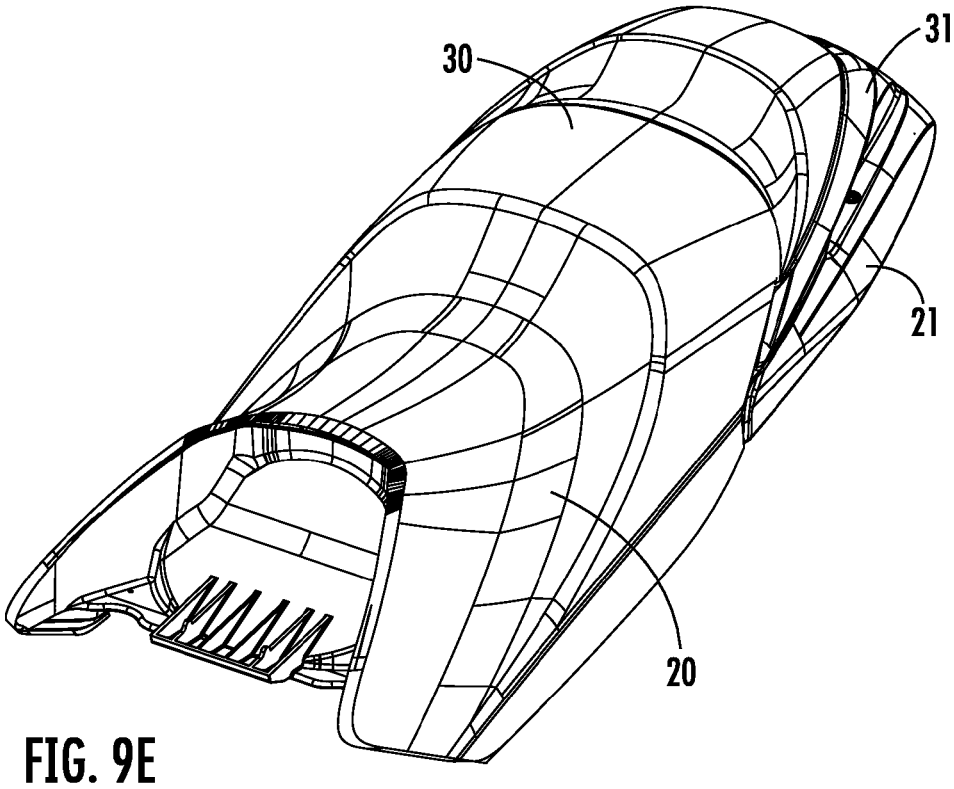

FIGS. 9A to 9E show an assembly process for providing a two-person configuration for the water vehicle. As shown in FIG. 9A, the common base member 21 is mounted to the deck 10 (as shown in FIG. 3). The hand grip 31 is then mounted on the common base member 21 as shown in FIG. 9B. The water tight container 50 is then disposed in the opening 22 in the common base member 21 as shown in FIG. 9C. The rear seat member 30 is then mounted on the common base member 21 as shown in FIG. 9D, by inserting the projections 33 on the rear seat member 30 into the receptacles 24 of the common base member 21, and by engaging the mounting member 36 with the mounting peg 28 on the common base member 21 (see, for example, FIGS. 4B and 6C). And finally, the front seat member 20 is mounted on the deck 10 so as to engage the rear seat member 30 as shown in FIG. 9E so as to provide the two-person configuration shown in FIG. 1.

Figure 10A:
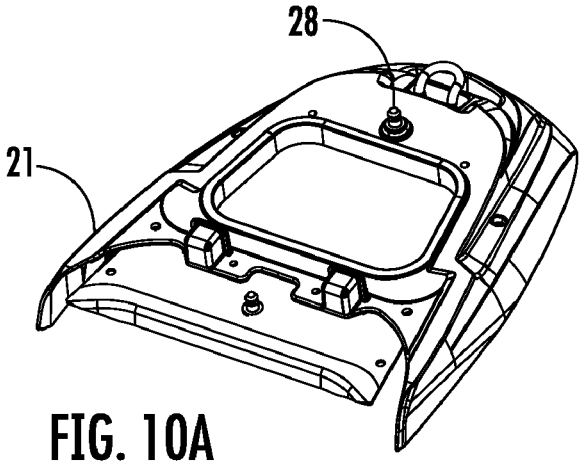
FIGS. 10A to 10E show a process of assembling the interchangeable seat system into a three-person configuration.
Figure 10B:
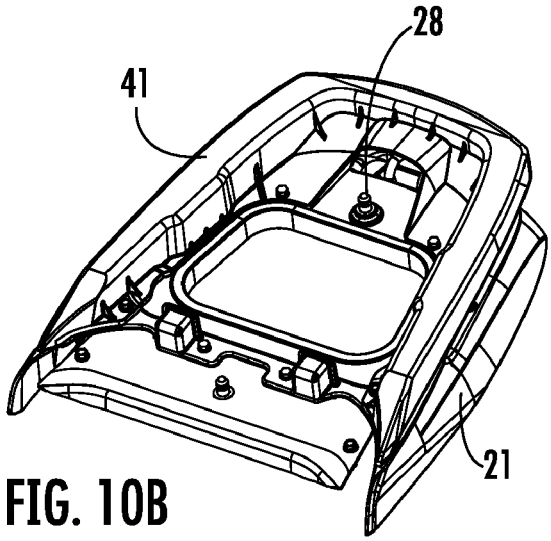
Figure 10C:
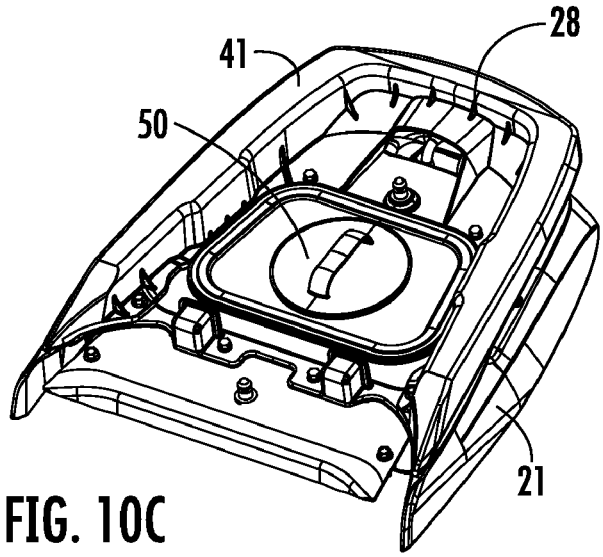
Figure 10D:
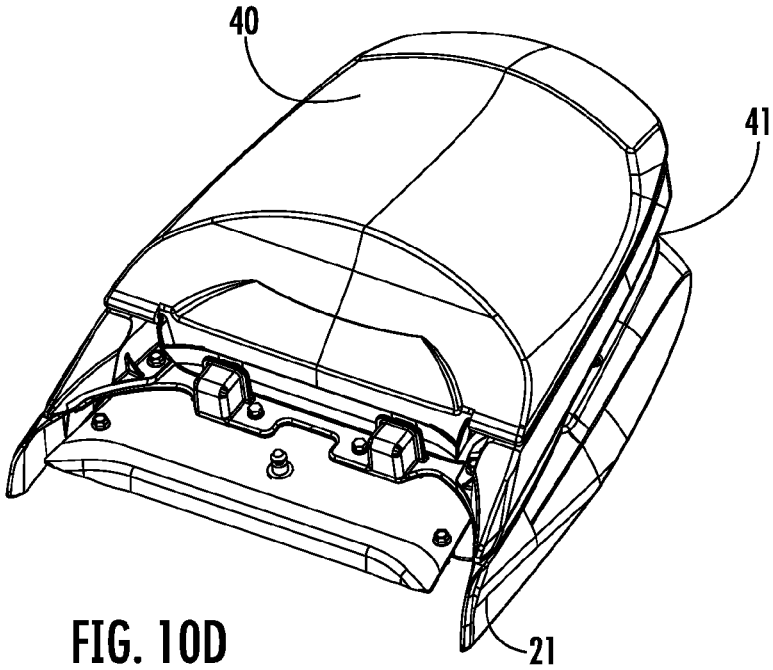
Figure 10E:
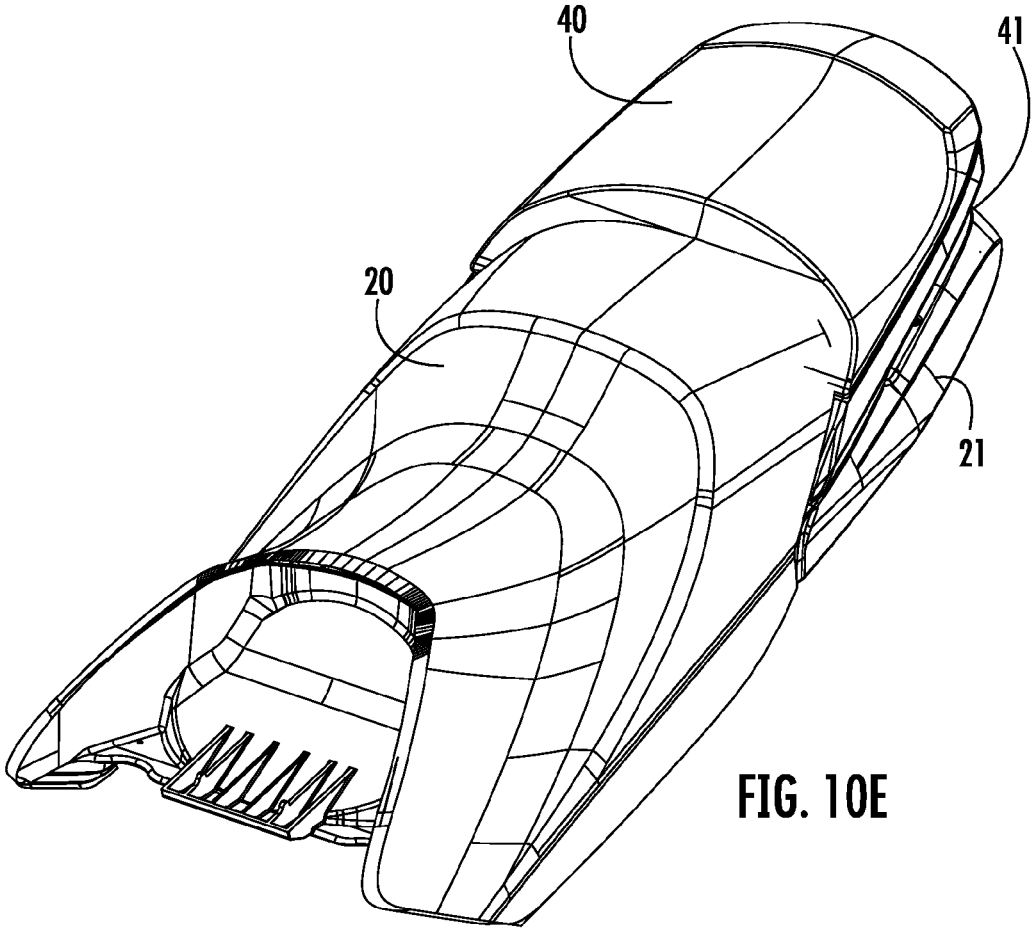

FIGS. 10A to 10E show an assembly process for providing a three-person configuration for the water vehicle. As shown in FIG. 10A, the common base member 21 is mounted to the deck 10 (as shown in FIG. 3). The hand grip 41 is then mounted on the common base member 21 as shown in FIG. 10B. The water tight container 50 is then disposed in the opening 22 in the common base member 21 as shown in FIG. 10C. The rear seat member 40 is then mounted on the common base member 21, as shown in FIG. 10D, by inserting the projections 43 on the rear seat member 30 into the receptacles 24 of the common base member 21, and by engaging the mounting member 46 with the mounting peg 28 of the common base member 21 (see, for example, FIGS. 4B and 8C). And finally, the front seat member 20 is mounted on the deck 10 so as to engage the rear seat member 40 as shown in FIG. 10E so as to provide the three-person configuration shown in FIG. 2.

Each of the front seat member 20, the rear seat member 30, and the rear seat member 40 preferably includes a cushion material, such as foam, that is covered with a durable, flexible material, such as vinyl. However, any suitable materials may be used for the front seat member 20, the rear seat member 30, and the rear seat member, such as foam covered with leather, or a foam that is processed to form an outer skin that has the appearance of vinyl.

The interchangeable seat system according to the preferred embodiment of the present invention include the hand grips 31 and 41 that are attached to the common base member 21 before the rear seat members 30 and 40, respectively, are attached. Alternatively, the hand grips 31 and 41 may be omitted, and the rear seat members 30 and 40 may be attached directly to the common base member 21, or the hand grips 31 and 41 may be integrated with the rear seat members 30 and 40, respectively.

With the preferred embodiment of the present invention, since the front seat member 20 and the common base member 21 are common components in the two-person configuration and in the three-person configuration, the water vehicle can be easily and selectively configured in a two-person configuration or a three-person configuration, and the assembly costs are reduced accordingly. In addition, the water vehicle can be easily reconfigured at any desired time after being purchased. For safety reasons, the reconfiguration of the water vehicle is not intended to be performed by the owner, but rather is intended to be performed only by the manufacturer or an authorized dealer. To prevent owners from reconfiguring the interchangeable seat system, special fasteners are used during production of the water vehicle to dissuade tampering and removal of the hand grip.

The current market for two-person water vehicles does not produce a volume large enough to justify the required investment to produce them. Using the interchangeable seat system according to the preferred embodiment of the present invention enables a manufacturer to invest in three-person water vehicles, while still being able produce new two-person water vehicles.

Furthermore, the interchangeable seat system according to the preferred embodiment of the present invention reduces the number of parts required to produce water vehicles, simplifies warehousing due to the reduced number of parts, and facilitates manufacturing of two-person and three-person water vehicles.

The preferred embodiment described above describes an interchangeable seat system which provides a two-person seat configuration and a three-person seat configuration. However, the interchangeable seat system according to preferred embodiments of the present invention may provide a one-person configuration and a two-person configuration, or a three-person configuration and a four-person configuration.

In addition, the interchangeable seat system according to preferred embodiments of the present invention may include more than two rear seat members and two hand grips to provide more than two seating configurations.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An interchangeable seat system for a water vehicle comprising:

a front seat member;

a common base member; and at least two rear seat members; wherein the common base member includes at least one member arranged to allow the common base member to be attached to a deck of the water vehicle;

one of the at least two rear seat members is configured such that a combination of the front seat member, the common base member, and the one of the at least two rear seat members mounted to the common base member provides a two-person seat configuration for the water vehicle;

another one of the at least two rear seat members is configured such that a combination of the front seat member, the common base member, and the another one of the at least two rear seat members mounted to the common base member provides a three-person seat configuration for the water vehicle; and the common base member is defined by a single element arranged to extend entirely between the deck and the one of the at least two rear seat members in the two-person seat configuration and entirely between the deck and the another one of the at least two rear seat members in the three-person seat configuration.

2. The interchangeable seat system according to claim 1, further comprising:

at least two hand grips; wherein the one of the at least two rear seat members and one of the at least two hand grips are configured such that a combination of the front seat member, the common base member, the one of the at least two rear seat members, and the one of the at least two hand grips provides a two-person seat configuration for the water vehicle; and the another one of the at least two rear seat members and another one of the at least two hand grips are configured such that a combination of the front seat member, the common base member, the another one of the at least two rear seat members, and the another one of the at least two hand grips provides a three-person seat configuration for the water vehicle.

3. The interchangeable seat system according to claim 1, wherein in the two-person seat configuration, the one of the at least two rear seat members is mounted on the common base member; and in the three-person seat configuration, the another one of the at least two rear seat members is mounted on the common base member.

4. The interchangeable seat system according to claim 2, wherein in the two-person seat configuration, the one of the at least two rear seat members and the one of the at least two hand grips are mounted on the common base member; and in the three-person seat configuration, the another one of the at least two rear seat members and the another one of the at least two hand grips are mounted on the common base member.

5. The interchangeable seat system according to claim 3, wherein the common base member includes at least one receptacle;

each of the at least two rear seat members includes at least one projection arranged to be engaged with the at least one receptacle of the common base member when a respective one of the at least two rear seat members is mounted on the common base member.

6. The interchangeable seat system according to claim 3, further comprising:

a container; wherein the common base member includes an opening arranged to accommodate the container therein.

7. The interchangeable seat system according to claim 6, wherein each of the at least two rear seat members includes a sealing member disposed on a lower surface thereof; and the sealing member is arranged to be engaged with the container when a respective one of the at least two rear seat members is mounted on the common base member so as to provide a water tight seal between the container and the respective one of the at least two rear seat members.

8. The interchangeable seat system according to claim 4, wherein the common base member includes at least one receptacle;

each of the at least two rear seat members includes at least one projection arranged to be engaged with the at least one receptacle of the common base member when a respective one of the at least two rear seat members is mounted on the common base member.

9. The interchangeable seat system according to claim 4, further comprising:

a container; wherein the common base member includes an opening arranged to accommodate the container therein.

10. The interchangeable seat system according to claim 9, wherein each of the at least two rear seat members includes a sealing member disposed on a lower surface thereof; and the sealing member is arranged to be engaged with the container when a respective one of the at least two rear seat members is mounted on the common base member so as to provide a water tight seal between the container and the respective one of the at least two rear seat members.

11. A water vehicle comprising:

a hull;

a deck attached to the hull;

and the interchangeable seat system recited in claim 1 arranged to be mounted on the deck.

12. The water vehicle according to claim 11, wherein the deck includes an access opening; and the interchangeable seat system is arranged to cover the access opening.

13. A method of mounting a seat on a deck of a water vehicle comprising the steps of:

mounting a common base member on the deck by attaching at least one member on the common base member to the deck;

selectively mounting one of at least two rear seat members on the common base member; and mounting a front seat member on the deck, forward of the one of at least two rear seat members in a longitudinal direction of the water vehicle, after the one of the at least two rear seat members has been mounted on the common base member; wherein one of the at least two rear seat members is configured such that a combination of the front seat member, the common base member, and the one of the at least two rear seat members forms a two-person seat configuration; and another one of the at least two rear seat members is configured such that a combination of the front seat member, the common base member, and the another one of the at least two rear seat members forms a three-person seat configuration.

14. The method according to claim 13, wherein the deck includes an access opening; and the common base member, the one of the at least two rear seat members, and the front seat member are mounted so as to cover the access opening.

15. The method according to claim 13, wherein the step of mounting the one of the at least two rear seat members includes the step of inserting at least one projection provided on the one of the at least two rear seat members into at least one receptacle provided on the common base member.

16. The method according to claim 13, further comprising the steps of:

providing a container in an opening in the common base member;

providing a sealing member on a lower surface of the one of the at least two rear seat members; and forming a water tight seal between the one of the at least two rear seat members and the container in the step of mounting the one of the at least two rear seat members.

17. The method according to claim 13, wherein the step of mounting the common base member on the deck includes:

mounting the common base member on the deck while arranging a single element of the common base member to extend continuously between the deck and the one of the at least two rear seat members in the two-person seat configuration, and mounting the common base member on the deck while arranging the single element of the common base member to extend continuously between the deck and the another one of the at least two rear seat members in the three-person seat configuration.

18. A method of mounting a seat on a deck of a water vehicle comprising the steps of:

mounting a common base member on the deck;

selectively mounting one of at least two hand grips on the common base member;

selectively mounting one of at least two rear seat members on the one of the at least two hand grips and on the common base member; and mounting a front seat member on the deck after the one of the at least two hand grips and the one of the at least two rear seat member have been mounted on the common base member; wherein one of the at least two rear seat members and one of the at least two hand grips are configured such that a combination of the front seat member, the common base member, the one of the at least two rear seat members and the one of the at least two hand grips forms a two-person seat configuration; and another one of the at least two rear seat members and another one of the at least two hand grips are configured such that a combination of the front seat member, the common base member, the another one of the at least two rear seat members, and the another one of the at least two hand grips forms a three-person seat configuration.

19. The method according to claim 18, wherein the deck includes an access opening; and the common base member, the one of the at least two hand grips, the one of the at least two rear seat members, and the front seat member are mounted so as to cover the access opening.

20. The method according to claim 18, wherein the step of mounting the one of the at least two rear seat members includes the step of inserting at least one projection provided on the one of the at least two rear seat members into at least one receptacle provided on the common base member.

21. The method according to claim 18, further comprising the steps of:

providing a container in an opening in the common base member;

providing a sealing member on a lower surface of the one of the at least two rear seat members; and forming a water tight seal between the one of the at least two rear seat members and the container in the step of mounting the one of the at least two rear seat members.

22. An interchangeable seat system for a water vehicle comprising:

a front seat member;

a common base member; and at least two rear seat members; wherein one of the at least two rear seat members is configured such that a combination of the front seat member, the common base member, and the one of the at least two rear seat members provides a two-person seat configuration for the water vehicle;

another one of the at least two rear seat members is configured such that a combination of the front seat member, the common base member, and the another one of the at least two rear seat members provides a three-person seat configuration for the water vehicle;

the one of the at least two rear seat members includes a plurality of mounting members;

the another one of the at least two rear seat members includes a plurality of mounting members; and the plurality of mounting members of the one of the at least two rear seat members are arranged to be mounted to the common base member at the same positions on the common base member as the plurality of mounting members of the another one of the at least two rear seat members are arranged to be mounted to the common base member.

* * * * *